US006095638A

United States Patent [19]

Suetsugu et al.

[11] Patent Number: 6,095,638

[45] Date of Patent: Aug. 1, 2000

[54] ELASTIC INK JET PRINTING HEAD AND METHOD FOR MANUFACTURING HEAD BLOCK THEREOF

[75] Inventors: Junichi Suetsugu; Kazuo Shima; Tadashi Mizoguchi; Hitoshi Minemoto; Hitoshi Takemoto; Tomoya Saeki; Yoshihiro Hagiwara; Toru Yakushiji, all of Niigata, Japan

[73] Assignee: NEC Corporation, Tokyo, Japan

[21] Appl. No.: 08/972,729

[22] Filed: Nov. 18, 1997

[30] Foreign Application Priority Data

Nov. 21, 1996 [JP] Japan ..... 8-310438
Dec. 9, 1996 [JP] Japan ..... 8-328417

[51] Int. Cl.[7] ..... B41J 2/06

[52] U.S. Cl. ..... 347/55

[58] Field of Search ..... 347/55, 84, 103, 347/68, 70, 71, 154, 123, 111, 159, 127, 128, 17, 141, 120, 151; 29/890.01; 399/271, 290, 292, 293, 294, 295

[56] References Cited

U.S. PATENT DOCUMENTS 4,806,956 2/1989 Nishikawa et al. .

FOREIGN PATENT DOCUMENTS 0 703 080 3/1996 European Pat. Off. .

WO 93/11866 6/1993 WIPO .

*Primary Examiner*—John Barlow
*Assistant Examiner*—Raquel Yvette Gordon
*Attorney, Agent, or Firm*—Young & Thompson

[57] ABSTRACT

An electrostatic ink jet printing head includes a head block made of insulating material having a first surface and a second surface which are intercrossing substantially at a right angle. A plurality of ink channel grooves are formed on the first surface and the second surface in directions perpendicular to a ridge between the two surfaces. A plurality of recording electrodes are formed on convexities between the ink channel grooves and near ejection points located on the ridge. A cover is attached to the head block for covering the ink channel grooves and exposing the ejection points to the air. Ink is forcibly circulated by a forcible ink circulation means such as a pump. The recording electrodes are formed in the lower reaches of the ink stream compared to the ejection points, and a plurality of electrophoresis electrodes are formed in the ink channel grooves in the upper reaches of the ink stream compared to the ejection points. According to the electrostatic ink jet printing head, excessively higher concentration of the toner particles at the ejection points is prevented and stable ejection of the ink from each ejection point can be executed independently of history of ejection of each recording electrode, and stable ejection of the ink from definite and precise ejection points can be executed, thereby high precision clear printing is realized with a simple structure of the head and at a low cost.

17 Claims, 14 Drawing Sheets

ELASTIC INK JET PRINTING HEAD AND METHOD FOR MANUFACTURING HEAD BLOCK THEREOF

BACKGROUND OF THE INVENTION

The present invention relates to an electrostatic ink jet printing head for executing printing by ejecting agglomerations of electrically charged toner particles in ink into a recording surface by means of electrostatic force, and to a method for manufacturing a head block composing the electrostatic ink jet printing head.

DESCRIPTION OF THE PRIOR ART

The non-impact printing method has attracted considerable attention because of its unnoticeably low printing noise, and has been a popular printing method these days. In the non-impact printing method, the ink jet printing is the most prevailing since direct printing on a recording surface is possible with an apparatus of simple construction and mechanism, and printing on plain paper is possible.

Various kinds of methods for the ink jet printing have been proposed such as the electrostatic ink jet printing method. In the electrostatic ink jet printing method, a plurality of recording electrodes and a counter electrode are placed in front of paper and behind the paper respectively, and recording is executed by ejecting agglomerations of electrically charged toner particles in ink from the recording electrodes into the paper by means of electrostatic force due to electric field produced by high voltage pulse signals applied between the recording electrodes and the counter electrode, The ink used in the method includes electrically charged toner particles suspended in carrier liquid which is an insulating solvent.

As disclosed in PCT Publication Number WO 93/11866 for example, an apparatus for electrostatic ink jet printing comprises an electrostatic ink jet printing head placed in front of paper for ejecting charged toner particles and a counter electrode placed behind the paper for generating electric field between the head and itself. A plurality of ejection electrodes are formed at the end of an ink supply channel and voltage is applied between selected ejection electrodes and the counter electrode in order to eject the toner particles from the selected ejection electrodes. The tip of the ejection electrodes face the counter electrode. The ink in the ink supply channel is fed into the tip of the ejection electrode by its surface tension, thereby ink meniscuses are formed at the tips of the ejection electrodes.

The ink used for the electrostatic ink jet printing head includes electrically charged toner particles for coloring. The electrically charged toner particle is positively charged by zeta potential. The ink remains electrically neutral when the voltage is not applied to the ejection electrodes. The polarity of the zeta potential depends on the characteristics of the electrically charged toner particle. When positive voltage is applied to the ejection electrode, the electric potential of the ink becomes positive and the electrically charged particles are moved toward the tip of the ejection electrode by the electric field caused by the voltage applied between the ejection electrode and the counter electrode. The electrically charged toner particles which have reached the tip of the ejection electrode are strongly attracted toward the counter electrode by the electric field between the ejection electrode and the counter electrode. When the Coulomb's force between the electrically charged particles on the tip of the ejection electrode and the counter electrode largely exceeds the surface tension of the ink, agglomerations of the electrically charged toner particles accompanied by a little liquid fly from the tip of the ejection electrode toward the counter electrode, thereby the agglomerations are applied on the paper. Printing by the electrostatic ink jet printing head is executed as described above, by ejecting agglomerations of the electrically charged particles one after another from the ejection electrodes toward the counter electrode by the voltage selectively applied to the ejection electrodes.

FIG. 1 is a perspective view of an example of a conventional electrostatic ink jet printing head which is disclosed in Japanese Patent Application No.07-120252. FIG. 2 is a plan view of the front part of the conventional electrostatic ink jet printing head. FIG. 3 is a vertical-sectional view of FIG. 2 taken along the line 3—3. The conventional electrostatic ink jet printing head comprises a planar main body 51 made of insulating material such as glass and an upper cover 54 made of insulating material which is attached to the main body 51. On the surface of the main body 51, a plurality of recording electrodes 52 facing into a direction of ejection are arranged at intervals corresponding to the printing resolution desired for the head. For example, in the case where the desired printing resolution is 300 dpi (dot per inch), the recording electrodes 52 are arranged at intervals of approximately 85 $\mu$m. The upper cover 54 is provided with an ink supply hole 55 and an ink outlet hole 56.

The recording electrodes 52 are formed by sputtering electrically conducting material such as Cu, Ni, Cr, etc. on the entire surface of the main body 51, and patterning the conducting material by photo-lithography. Each recording electrode 52 is formed as an independent electrode from each other, and an end of each recording electrode 52 is connected to an unshown driver which is provided to the main body of the printer. High voltage pulse signals are applied to selected recording electrodes 52 by the driver when printing is executed. Insulator coating material is spin-coated on the surface of the main body 51 provided with the recording electrodes 52 in order to insulate between the recording electrodes 52 and the ink.

A plurality of meniscus forming members 53 corresponding to each of the recording electrodes 52 are provided between the main body 51 and the upper cover 54. The meniscus forming member 53 is formed overlapping with a corresponding recording electrode 52 at a little recessed position compared to the tip of the recording electrode 52, by laminating or spin-coating insulating photoresist material on the main body 51 which has been provided with the recording electrodes 52, and patterning the insulating photoresist material by photo-lithography. The thickness of the meniscus forming member 53 is approximately 30 $\mu$m and the width of the meniscus forming member 53 is also approximately 30 $\mu$m. The edge of the upper cover 54 is placed at a more recessed position than the tips of the meniscus forming members 53.

Between the main body 51 and the upper cover 54, slit-like ink ejection holes 57 are formed between each meniscus forming member 53. The tips of the meniscus forming members 53 protrude from the edge of the upper cover 54. The meniscus forming member 53 formed on the recording electrode 52 stretches under the upper cover 54 in order to support the upper cover 54, and ink channels 50 are formed between the meniscus forming members 53. An ink chamber 64 is formed surrounded by the main body 51, the upper cover 54, and the rear ends of the meniscus forming members 53. The ink supplied from the ink supply hole 55 is fed into the ink ejection holes 57 via the ink chamber 54 and the ink channels 50, reach the protruding tips of the meniscus forming members 53, and form ink meniscuses 65 as shown in FIG. 2.

To the rear of the ink channels 50, an electrophoresis electrode 60 is provided as shown in FIG. 3 in order to apply electric field to the ink and cause electrophoresis and condensation of the electrically charged toner particles in the ink into the tips of the meniscus forming members 53. A counter electrode 63 is placed behind the paper 62 as shown in FIG. 3. The electrically charged toner particles in the ink are moved by the electric field applied between the electrophoresis electrode 60 and the counter electrode 63 through the ink channels 50 and are concentrated around the tips of the meniscus forming members 53. Printing is executed by applying high voltage pulse signals to selected recording electrodes 52 by an unshown driver and ejecting agglomerations of the concentrated toner particles toward the counter electrode 63 and the paper 62 by the voltage between the recording electrodes 52 and the counter electrode 63.

However, in the conventional electrostatic ink jet printing head, stable ejection of the toner particles can not executed. The electrically charged toner particles in ink are continuously moved toward the ink ejection holes 57 by the electric field between the electrophoresis electrode 60 and the counter electrode 63, and the toner particles concentrate around the ink ejection holes 57. If ejection by some of the recording electrodes 52 is not executed for a long time, the toner particles having no outlets continue concentrating, and the concentration of the toner particles becomes excessively higher at the ink ejection holes 57 corresponding to the recording electrodes 52, causing instability of ejection by the recording electrodes 52. In other words, the toner concentrations at each recording electrode 52 vary depending on the history of ejection of the recording electrode 52, causing uneven and not uniform ejection by each recording electrode 52.

Further, stable ejection from a definite and precise ejection point is impossible by the conventional electrostatic ink jet printing head. The meniscus forming members 53 which compose the ejection point are formed on the flat main body 51 and at a little recessed position compared to the edge of the main body 51, therefore, the ink meniscus may overflow from the meniscus forming members 53 for some causes and reach the edge of the main body 51. If the high voltage driving pulse signal is applied to the recording electrode 52 in such a situation, ejection of the toner particles may occur at any position on the edge of the main body 51 and stable ejection from a definite and precise ejection point can not be executed.

SUMMARY OF THE INVENTION

It is therefore the primary object of the present invention to provide an electrostatic ink jet printing head in which unstable or uneven ejection of the toner particles caused by excessively higher concentration of the toner particles at the ejection points is prevented and continuous supply of fresh ink into the ejection points is possible independently of ejection history of the recording electrodes, thereby reliability of stable and uniform ejection by the recording electrodes is improved.

Another object of the present invention is to provide an electrostatic ink jet printing head in which stable ejection of the ink from definite and precise ejection points can be executed and high precision clear printing is realized with a simple structure of the head and at a low cost.

Another object of the present invention is to provide method for manufacturing a head block which composes an electrostatic ink jet printing head, in which a head block capable of executing stable ejection and precision printing is manufactured in a simple process and at a low cost.

In accordance with the present invention, there is provided an electrostatic ink jet printing head comprising a head block made of insulating material having a first surface and a second surface which are intersecting substantially at a right angle. A plurality of ink channel grooves are formed on the first surface and the second surface in directions perpendicular to a ridge between the two surfaces. A plurality of recording electrodes are formed on convexities between the ink channel grooves and near ejection points located on the ridge, and the recording electrodes are coated with insulating material. A cover is attached to the head block for covering the ink channel grooves and exposing the ejection points to the air.

Preferably, ink is forcibly circulated by a forcible ink circulation means such as a pump from an ink tank through the ink channel grooves on the first surface, the ejection points, the ink channel grooves on the second surface, and to the ink tank.

Preferably, the recording electrodes are formed in the lower reaches of the ink stream compared to the ejection points.

Preferably, the electrostatic ink jet printing head further comprises a plurality of electrophoresis electrodes formed in the ink channel grooves in the upper reaches of the ink stream compared to the ejection points.

Preferably, the electrophoresis electrodes are formed so that contact length along the ink stream between the electrophoresis electrodes and the ink may be variable.

Preferably, the ink channel grooves are formed so as to become deeper toward the ejection point 13.

Preferably, the head block is attached to the tip of a head body as a head tip.

Preferably, the electrostatic ink jet printing head further comprises an ink supply chamber between an ink tank and the ink channel grooves on the first surface, and an ink outlet chamber between the ink channel grooves on the second surface and the ink tank.

Preferably, an electrophoresis electrode is provided in the ink supply chamber in contact with the ink.

Preferably, the ink outlet chamber is placed above the ink supply chamber.

Preferably, the ink channel grooves are formed by means of grooving by machining.

In accordance with another aspect of the present invention, there is provided an electrostatic ink jet printing head comprising a head block made of insulating material having a first surface and a second surface which are intercrossing substantially at a right angle, in which a plurality of ink channel grooves are formed on a ridge between the first surface and the second surface in a direction perpendicular to the ridge so that the bottoms of the ink channel grooves may be substantially at 45 degrees from the first surface and the second surface. A plurality of recording electrodes are formed on convexities between the ink channel grooves and near ejection points located on the ridge, and the recording electrodes are coated with insulating material. A cover is attached to the head block for covering the ink channel grooves and exposing the ejection points to the air.

Preferably, ink is forcibly circulated by a forcible ink circulation means such as a pump from an ink tank through the ink channel grooves, the ejection points, the ink channel grooves, and to the ink tank.

Preferably, the electrostatic ink jet printing head further comprises an electrophoresis electrode in the upper reaches of the ink stream compared to the ejection points.

Preferably, the ink channel grooves are formed by means of grooving by machining.

In accordance with another aspect of the present invention, there is provided a method for manufacturing a head block which composes an electrostatic ink jet printing head. The method comprises the following four steps. In the first step, a conductor layer is formed on a second surface of a block. The block is made of insulating material and has a first surface and the second surface which are intercrossing substantially at a right angle. In the second step, a plurality of ink channel grooves are formed on the second surface by means of grooving by machining, thereby a plurality of recording electrodes are formed. In the third step, a plurality of ink channel grooves are formed on the first surface by means of grooving by machining so that the ink channel grooves on the first surface may be connected with the ink channel grooves on the second surface. In the fourth step, an insulator coating layer is formed on the recording electrodes.

Preferably, the method further comprises the step of forming a plurality of electrophoresis electrodes on the bottoms of the ink channel grooves on the first surface.

BRIEF DESCRIPTION OF THE DRAWINGS

The objects and features of the present invention will become more apparent from the consideration of the following detailed description taken in conjunction with the accompanying drawings, in which:

FIG. 6A and FIG. 6B are enlarged details around the ejection points of the electrostatic ink jet printing head of FIG. 4, in which FIG. 6A is a plan view (the arrow B in FIG. 4)

DESCRIPTION OF THE PREFERRED EMBODIMENTS

Figure 1:
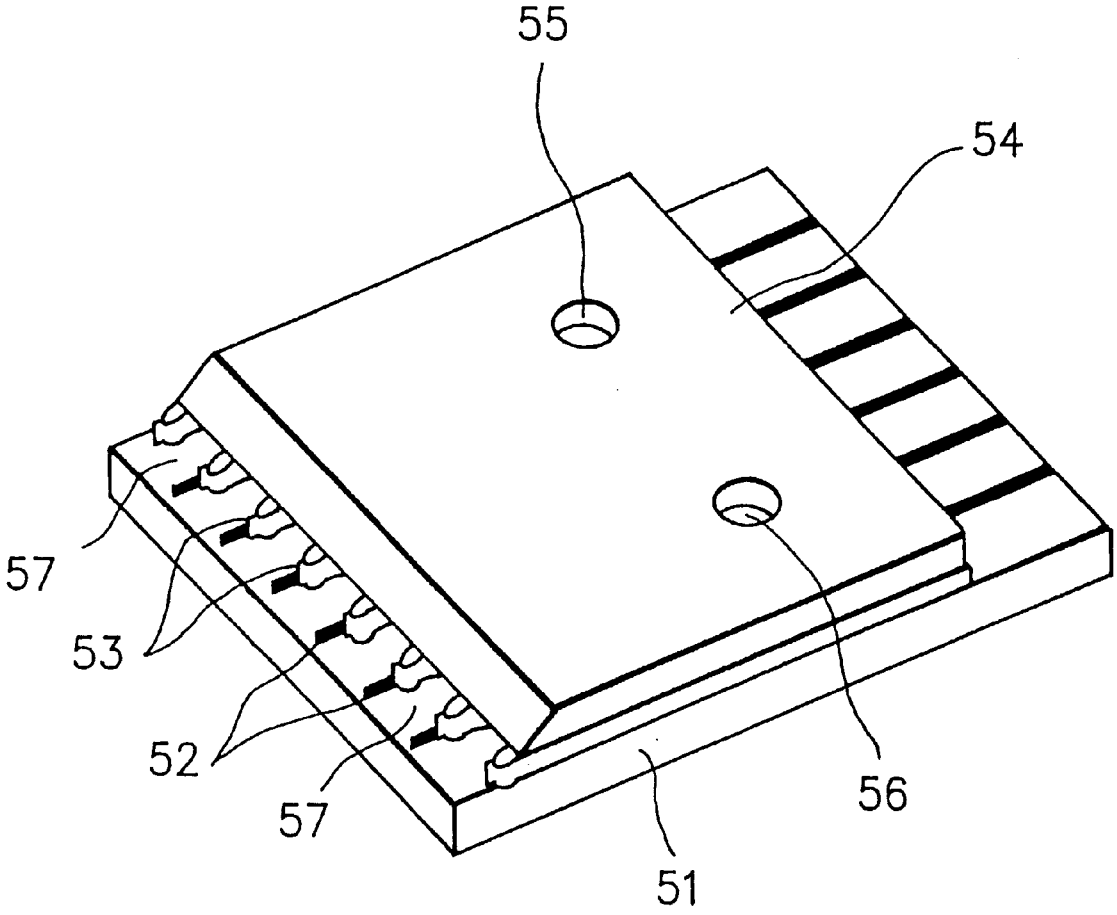
FIG. 1 PRIOR ART
FIG. 1 is a perspective view of an example of a conventional electrostatic ink jet printing head.
Figure 2:
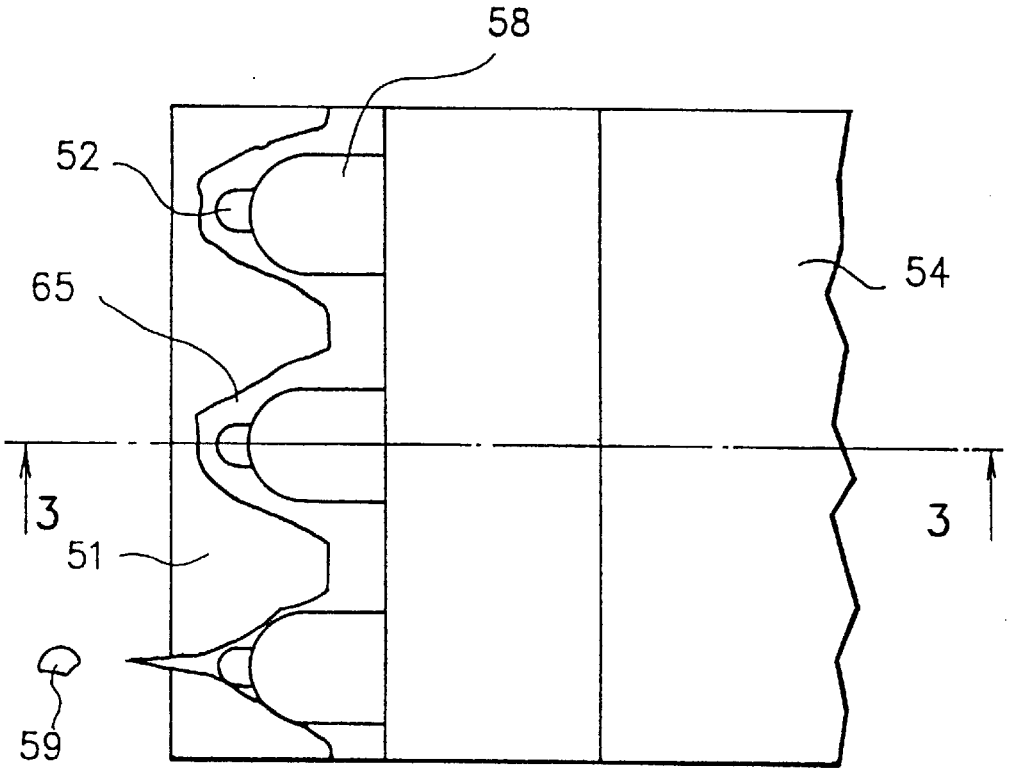
FIG. 2 PRIOR ART
FIG. 2 is a plan view of the front part of the conventional electrostatic ink jet printing head of FIG. 1.
Figure 3:
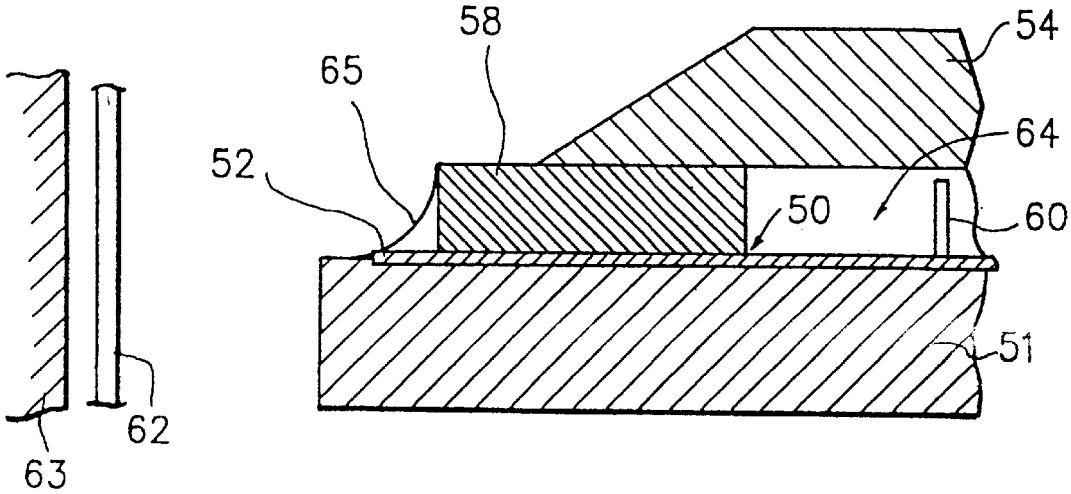
FIG. 3 PRIOR ART
FIG. 3 is a vertical-sectional view of the head of FIG. 3 taken along the line 3—3.

Referring now to the drawings, a description will be given in detail of preferred embodiments in accordance with the present invention.

Figure 4:
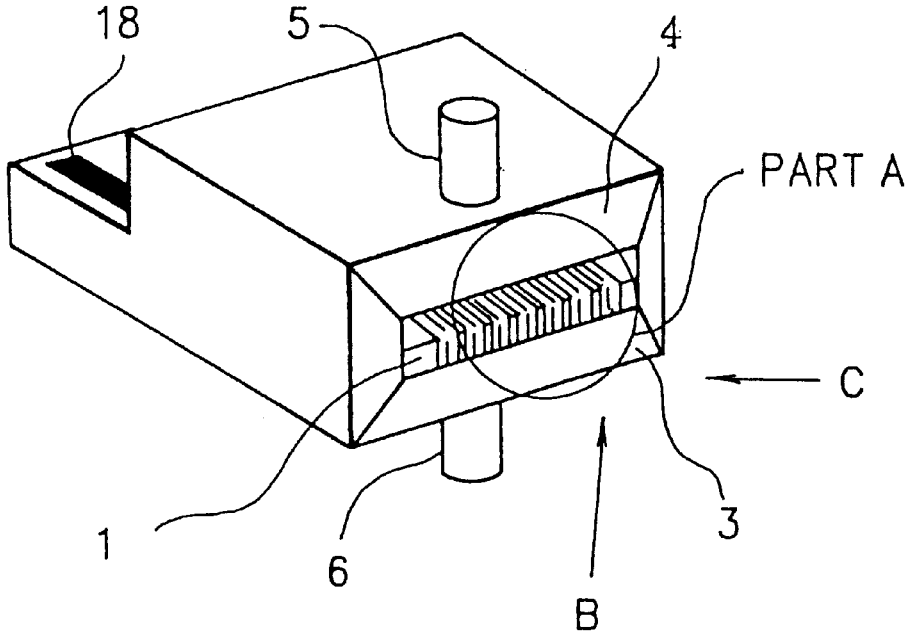
FIG. 4 is a perspective view of an electrostatic ink jet printing head according to an embodiment of the present invention.
Figure 5:
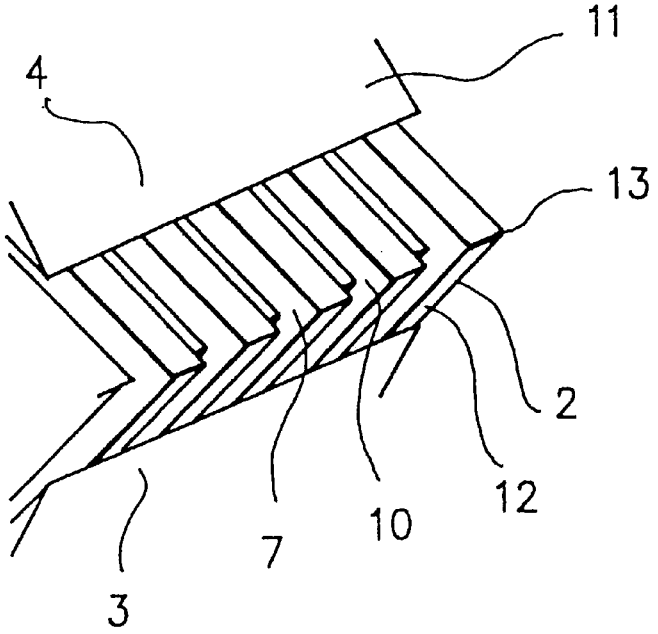
FIG. 5 is an enlarged detail of the front part (part A) of the electrostatic ink jet printing head of FIG. 4.

FIG. 4 is a perspective view of an electrostatic ink jet printing head according to an embodiment of the present invention. FIG. 5 is an enlarged detail of the front part (part A) of the electrostatic ink jet printing head of FIG. 4.

The electrostatic ink jet printing head comprises a main body 1 made of insulating material such as ceramics or glass from which a tip of substantially rectangular shape is protruding and forming a plurality of ejection points 13. A plurality of ink channel grooves 7 are formed on two surfaces which stretch on both sides of the protruding ridge of the tip. The ink channel grooves 7 are arranged, for example, at intervals of approximately 85 $\mu$m corresponding to 300 dpi. The depth and the width of the ink channel grooves 7 are approximately 100 $\mu$m and 65 $\mu$m, respectively. Each channel wall 10 which is partitioning the ink channel grooves 7 has a width of approximately 20 $\mu$m, and protruding parts of the channel walls 10 are forming the ejection points 13.

In each ink channel groove 7 on one surface (in FIG. 5, the upper surface) of the main body 1, an electrophoresis electrode 11 is patterned to keep in contact with the ink. The electrophoresis electrode 11 is formed by plating electrically conducting material such as copper to a thickness of 20–30 $\mu$m. On another surface (in FIG. 5, the lower surface) of the main body 1, recording electrodes 2 are patterned on each front flat surface of each channel wall 10 almost to the ridge. The recording electrodes 2 are arranged, for example, at intervals of approximately 85 $\mu$m corresponding to 300 dpi, since the ink channel grooves 7 are arranged at the same intervals for example. Further, the recording electrodes 2 are uniformly coated with an insulator coating layer 12 of a thickness less than 10 $\mu$m. Incidentally, the main body 1 of this embodiment is made of, for example, machinable ceramics block, and the ink channel grooves 7 on the two surfaces are formed by means of grooving by machining. However, the main body 1 may as well be formed at once by molding alumina etc. The insulator coating layer 12 is formed, for example, by CVD (chemical vapor deposition) of parylene resin.

An upper cover 4 and a lower cover 3 are attached to the main body 1 so as to cover parts of the two surfaces provided with the ink channel grooves 7 from the upper side and the lower side, and to expose the ejection points 13 provided with the recording electrodes 2 to the air. The upper cover 4 is made of insulating material, to which an ink supply hole 5 is previously provided. An ink chamber is formed by the inner surface of the upper cover 4, and is filled with the ink supplied from the ink supply hole 5. The lower cover 3 is also made of insulating material, to which an ink outlet hole 6 is previously provided. Another ink chamber is formed by the inner surface of the lower cover 3. The ink supplied from the ink supply hole 5 to the ink chamber inside the upper cover 4 is fed to the ejection points 13 via the ink channel grooves 7, and the toner particles in the ink is ejected at the ejection points 13 according to the application of high voltage driving pulse signals to the recording electrodes 2. The ink with residual toner particles is fed to the ink chamber inside the lower cover 3 via the ink channel grooves 7 and is discharged through the ink outlet hole 6.

The electrostatic ink jet printing head is connected to an unshown ink tank by tubes and the ink inside the head is circulated forcibly by pressure of approximately 1cm$H_2O$ applied to the ink. The ink comprises a petrochemical organic solvent (isoparaffin etc.) or a silicon oil, and colored thermoplastic resin particles (i.e. the toner), and an electrification control agent diffused in the solvent. The electrically charged toner particle is positively charged by zeta potential.

To each electrophoresis electrode 11 provided in each ink channel groove 7, a voltage of the same polarity as the toner potential is applied. The toner particles in the ink supplied from the ink supply hole 5 is transported to around the recording electrodes 2 by electrophoresis due to the electric field generated between the electrophoresis electrodes 11 and an unshown counter electrode. By the transportation of the toner particles by the electrophoresis and the supply of the ink into the ejection points 13 by forced circulation by a pump, the concentration of the toner particles becomes higher around the ejection points 13 than in the ink chamber in the upper stream.

Figure 6A:
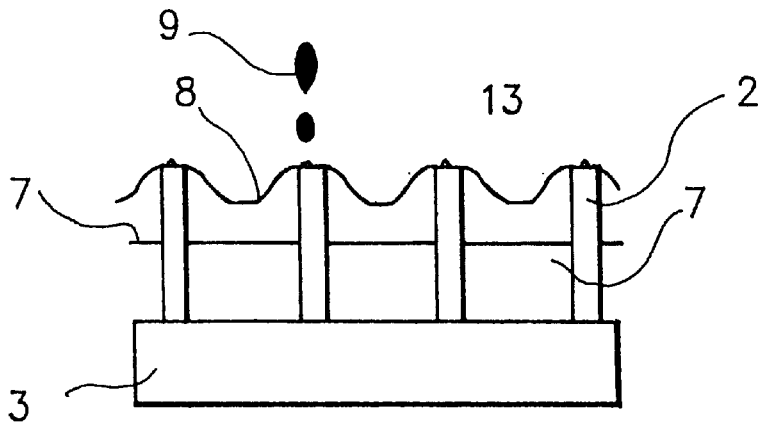
Figure 6B:
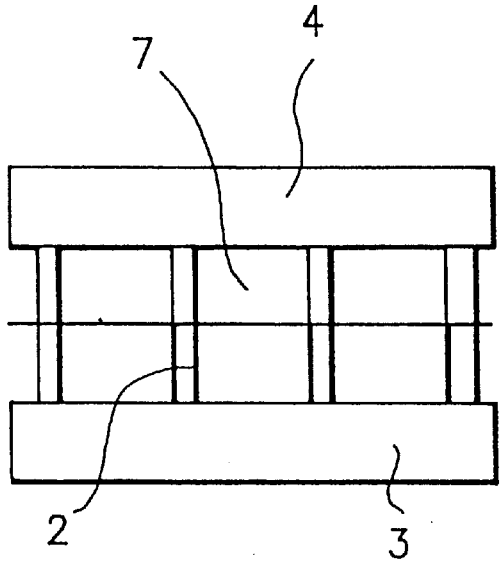

FIG. 6A and FIG. 6B are enlarged details around the ejection points 13 of the electrostatic ink jet printing head of this embodiment to which the ink is supplied, in which FIG. 6A is a plan view (the arrow B in FIG. 4) and FIG. 6B is a front view (the arrow C in FIG. 4). Referring to FIG. 6A, the ink meniscuses 8 are formed in each ink channel groove 7 between the ejection points 13 due to surface tension. The ink meniscuses 8 are formed discretely corresponding to each recording electrode 2 as shown in FIG. 6A since the ejection points 13 are separated by the ink channel grooves 7.

Therefore, when the high voltage driving pulse signal is applied to an arbitrary recording electrode 2, the electric field due to the driving pulse signal is concentrated on the protruding tip of an ink meniscus 8 on an ejection point 13 corresponding to the recording electrode 2.

The electrically charged toner particles in the ink is pulled out of the protruding tip of the ink meniscus 8 by the electric field generated between the unshown counter electrode and the recording electrode 2, and the agglomerations 9 of the electrically charged toner particles fly into the unshown counter electrode which is facing the recording electrode 2, i.e. into the recording surface of the paper. The toner particles which have formed a dot on the recording surface is heated by an unshown heater and fixed.

Figure 7:
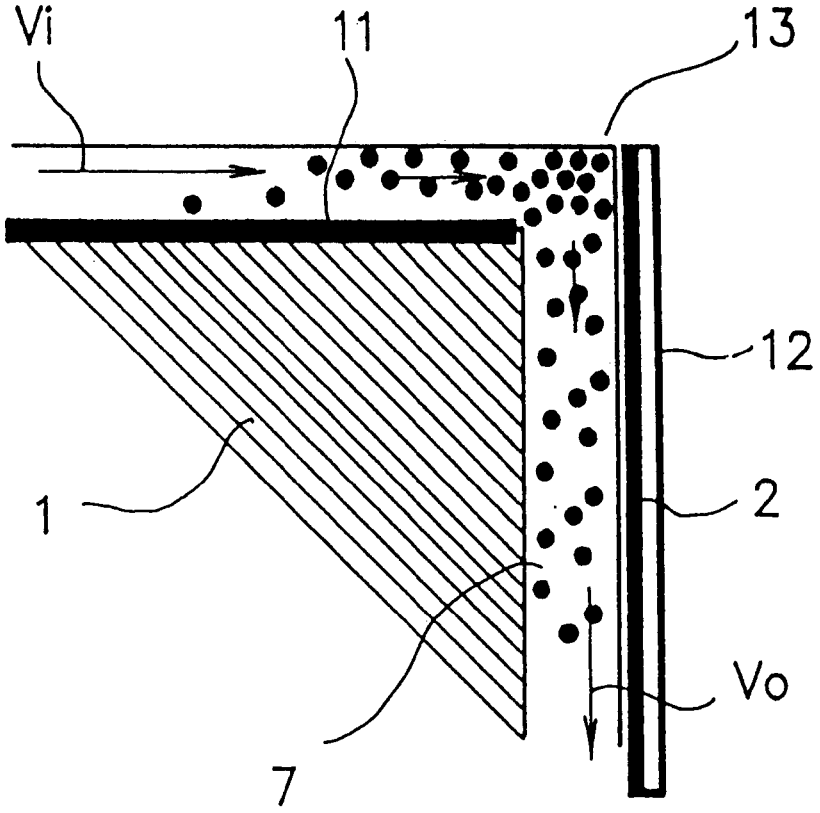
FIG. 7 is a vertical section of the tip of the electrostatic ink jet printing head of FIG. 4.

FIG. 7 is a vertical section of the tip of the electrostatic ink jet printing head of this embodiment. The ink supplied from the ink supply hole 5 flows in each discrete ink channel groove 7 to the ejection point 13 at an ink supply velocity $V_i$. The electrophoresis electrode 11 is formed on the bottom of the ink channel groove 7, and thus the toner particles in the ink are gradually concentrated near the free surface of the ink by the potential difference between the electrophoresis electrode 11 and the unshown counter electrode, and the toner particles are ejected from the ejection point 13 toward the unshown counter electrode. The ink with residual toner particles which have not been ejected from the ejection point 13 flows in the ink channel groove 7 to the ink chamber inside the lower cover 3 at an ink discharge velocity $V_o$, and is discharged through the ink outlet hole 6.

Figure 8A:
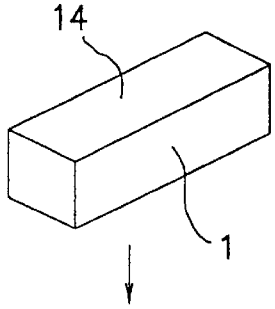
FIG. 8B is a front view (the arrow C in FIG. 4)
FIG. 8 is a schematic diagram showing steps involved in a manufacturing process of an electrostatic ink jet printing head of FIG. 4.
Figure 8B:
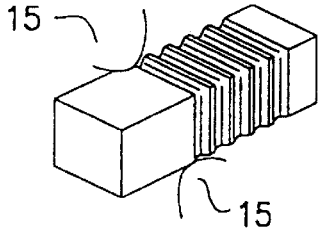
Figure 8C:
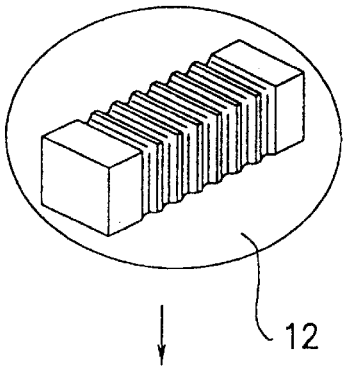
Figure 8D:
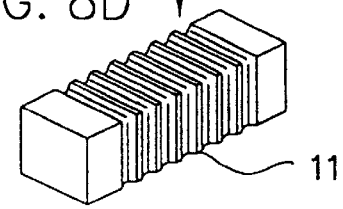
Figure 8E:
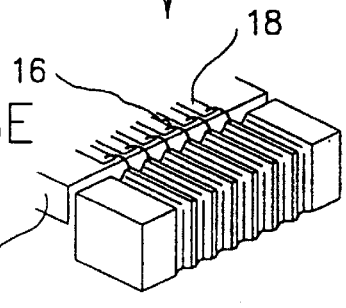
Figure 8F:
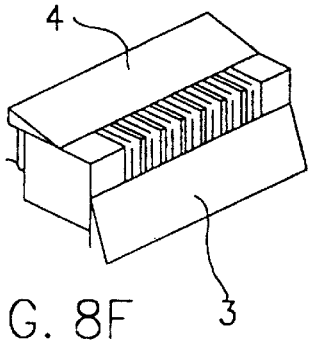

In the following, an example of a manufacturing process of the electrostatic ink jet printing head according to the present invention will be described. FIG. 8 is a schematic diagram showing steps involved in the manufacturing process according to this embodiment. First, a conductor layer 14 of electrically conducting materiel such as Cu, Ni, etc. is formed by sputtering or plating on a surface of the main body 1 which substantially has a shape of a rectangular parallelopiped (FIG. 8A). Subsequently, using a machining blade 15, grooves are formed on the surface on which the conductor layer 14 has been formed and on an adjacent surface which is perpendicular to the surface having the conductor layer 14, at intervals corresponding to printing resolution desired for the head. In this embodiment, the width and the depth of the groove are, for example, approximately 65 $\mu$m and 100 $\mu$m, respectively. Thus, the discrete recording electrodes 2 have been formed on the former surface (FIG. 8B). Subsequently, an insulator coating layer 12 is formed on the whole surface of the main body 1 by CVD (FIG. 8C). Then, the insulator coating layer 12 on the latter surface, i.e. on the grooved surface without the recording electrodes 2. is removed by abortion, and conductor layers of Cu, Ni, etc. are formed by sputtering etc. on the bases of the ink channel grooves 7 on the latter surface. Thus, the electrophoresis electrodes 11 have been formed on the latter surface (FIG. 8D). Incidentally, on the above formation of the insulator coating layer 12, it is as well possible to form the insulator coating layer 12 on the former surface only by masking the other surfaces, instead of coating the whole surface of the main body 1. After the ink channel grooves 7, the recording electrodes 2, and the electrophoresis electrodes 11 are formed on the main body 1 as above, the proximal ends of the recording electrodes 2 are connected to bonding pads 18 of a printed circuit board 17 by bonding wires 16 (FIG. 8E). Then, the lower cover 3 and the upper cover 4 are attached to the main body 1 so as to cover parts of the two surfaces from the upper side and the lower side, and to expose the ejection points 13 to the air (FIG. 8F).

According the above manufacturing process, the recording electrodes 2 and the ink channel grooves 7 can be formed in one grooving step using the machining blade 15, without executing complicated patterning process such as photolithography for the discrete recording electrodes 2.

Figure 9:
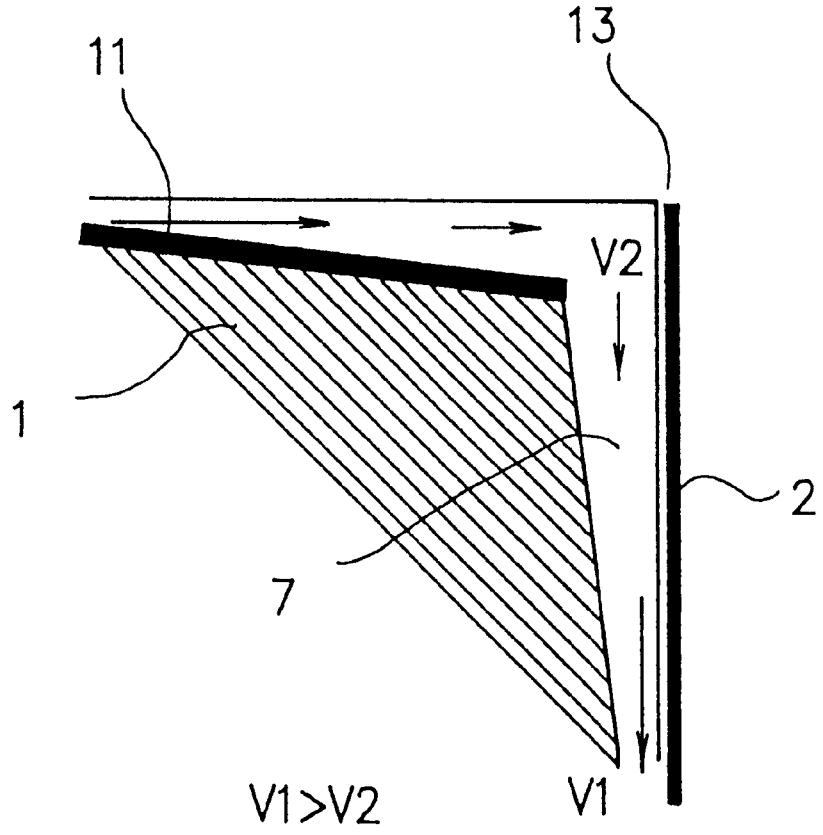
FIG. 9 is a vertical sectional view showing the tip of an electrostatic ink jet printing head according to the second embodiment of the present invention.

FIG. 9 is a vertical sectional view showing the tip of an electrostatic ink jet printing head according to the second embodiment of the present invention. As shown in FIG. 9, the ink jet printing head of the second embodiment has almost the same construction as the head of the first embodiment, except the shape of the ink channel groove 7. The ink channel groove 7 in the second embodiment is formed so as to become deeper toward the ejection point 13. Therefore, the ink velocity $V_2$ at a point near the ejection point 13 becomes slower than the ink velocity $V_1$ at a point far from the ejection point 13 according to Bernoulli's theorem, since the cross section of the ink channel groove 7 is larger at the point near the ejection point 13. At the ejection point 13, the direction of a stream vector of the ink is rapidly changed by a right angle, thereby irregular currents of the ink are generated at the ejection point 13 and loss of the stream flow occurs.

According to the second embodiment, the loss of the stream flow can be reduced since the ink velocity $V_2$ at the point near the ejection point 13 is reduced ($V_2<V_1$). Further, ejection energy needed for ejecting the toner particles from the ejection point 13 is reduced since the ink velocity $V_2$ near the ejection point 13 is slow. Furthermore, the amount of the ink around the ejection point 13 can be increased, thereby ejection of larger amount of the toner particles from the ejection point 13 is made possible.

Figure 10A:
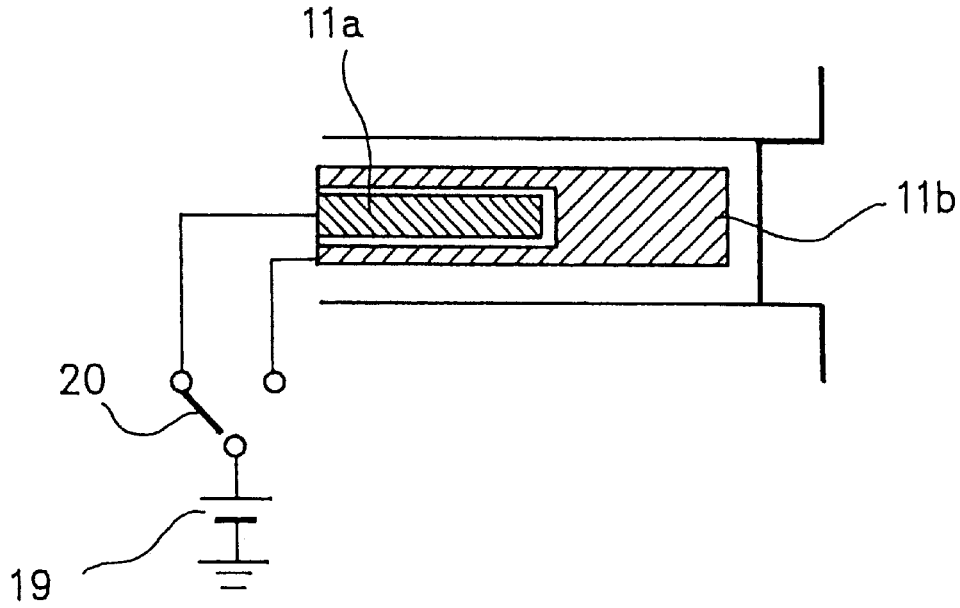
FIG. 10A and FIG. 10B are a plan view and a vertical sectional view showing the tip of an electrostatic ink jet printing head according to the third embodiment of the present invention.
Figure 10B:
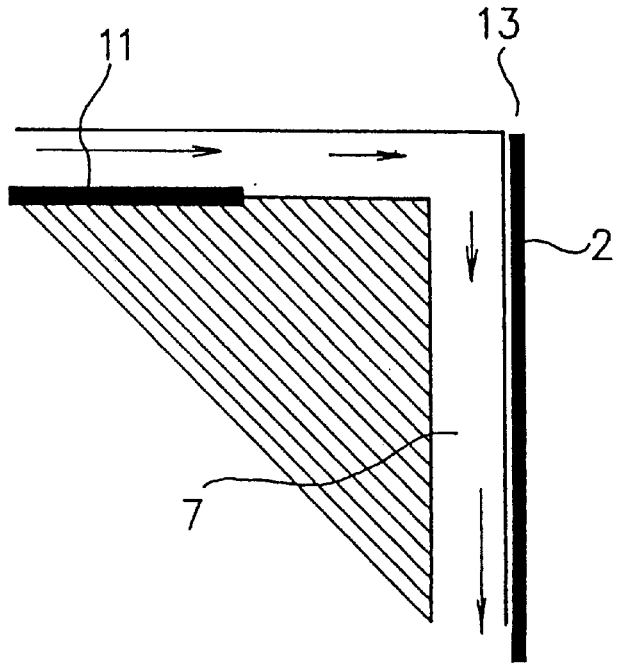

FIG. 10A and FIG. 10B are a plan view and a vertical sectional view showing the tip of an electrostatic ink jet printing head according to the third embodiment of the present invention. As shown in FIG. 10A and FIG. 10B, the ink jet printing head of the third embodiment has almost the same construction as the head of the first embodiment, except the construction of the electrophoresis electrode. The electrophoresis electrode in the third embodiment is composed of two electrophoresis electrodes 11a and 11b and each of them is connected to an electrophoresis voltage source 19 via a switch 20. When the switch 20 is on the side of the short electrophoresis electrodes 11*a*, contact length along the ink stream between the electrophoresis electrodes 11*a* and the ink becomes relatively short, thereby the concentration of the toner particles on the free surface of the ink becomes relatively low. On the contrary, when the switch 20 is on the side of the long electrophoresis electrodes 11*b* which extends almost to the ejection point 13, the contact length between the electrophoresis electrodes 11*b* and the ink becomes relatively long, therefore, the concentration of the toner particles on the free surface of the ink near the ejection point 13 becomes relatively high.

As described above, according to the third embodiment, it is possible to modulate the strength of the color of printing between two values by the switching of the switch 20.

Figure 11:
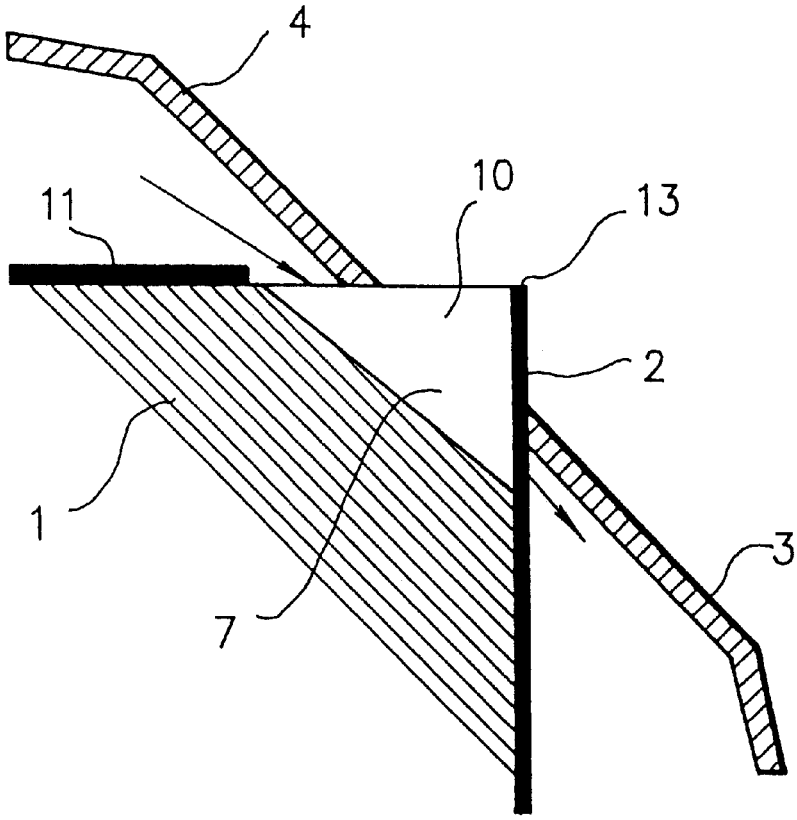
FIG. 11 is a vertical sectional view showing the tip of an electrostatic ink jet printing head according to the fourth embodiment of the present invention.
Figure 12:
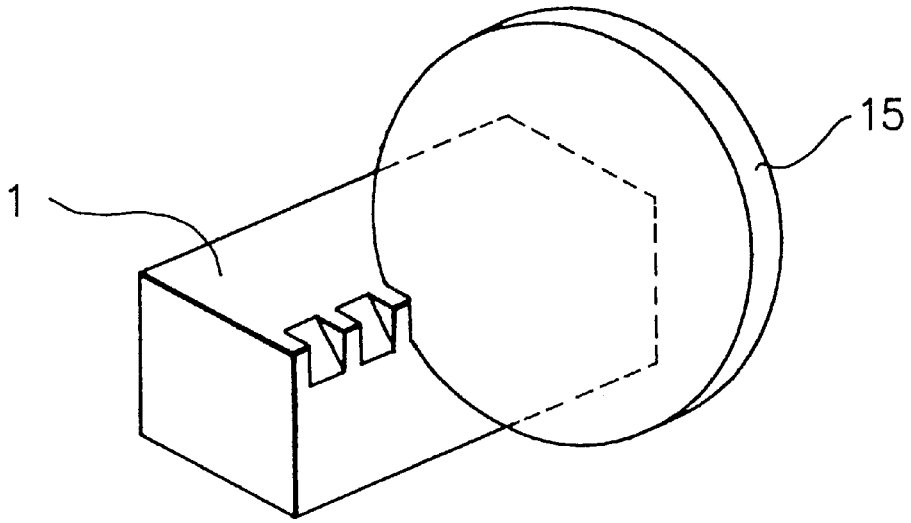
FIG. 12 is a schematic diagram showing grooving process of the electrostatic ink jet printing head of FIG. 11.

FIG. 11 is a vertical sectional view showing the tip of an electrostatic ink jet printing head according to the fourth embodiment of the present invention. As shown in FIG. 11, the ink jet printing head of the fourth embodiment has similar construction to the head of the first embodiment. However, the ink channel groove 7, the lower cover 3 and the upper cover 4 are different from those of the first embodiment. The ink channel grooves 7 of the fourth embodiment are not formed by executing grooving to the two surfaces of the main body 1, but are formed by executing grooving at once to one edge of the main body 1 where the ejection points 13 should be formed. The ink channel grooves 7 are formed using the machining blade 15 so that the bottoms of the grooves may be substantially at 45 degrees from the two surfaces of the main body 1, as shown in FIG. 12. The lower cover 3 and the upper cover 4 are formed so as to cover parts of the grooved areas of the two surfaces from the upper side and the lower side and to expose the ejection points 13 to the air.

According to the fourth embodiment, the ink channel grooves 7 in the upper stream and in the lower stream can be formed in only one step, by grooving the edge of the main body 1 using the machining blade 15, thereby production cost can be reduced. Further, the ink channel groove 7 of the fourth embodiment is made shorter than that of the first embodiment, therefore clogging up of the ink channel grooved 7 due to cohesion of the toner particles etc. can be prevented.

Figure 13:
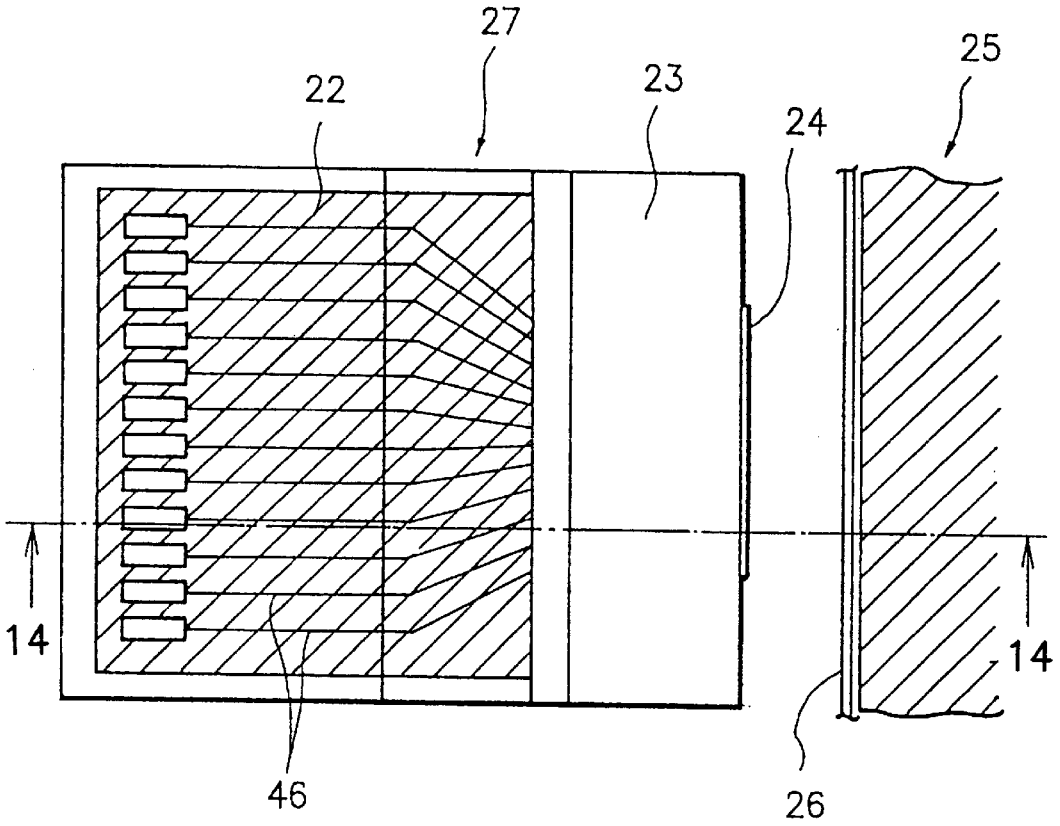
FIG. 13 is a plan view of an electrostatic ink jet printing head according to the fifth embodiment of the present invention.
Figure 14:
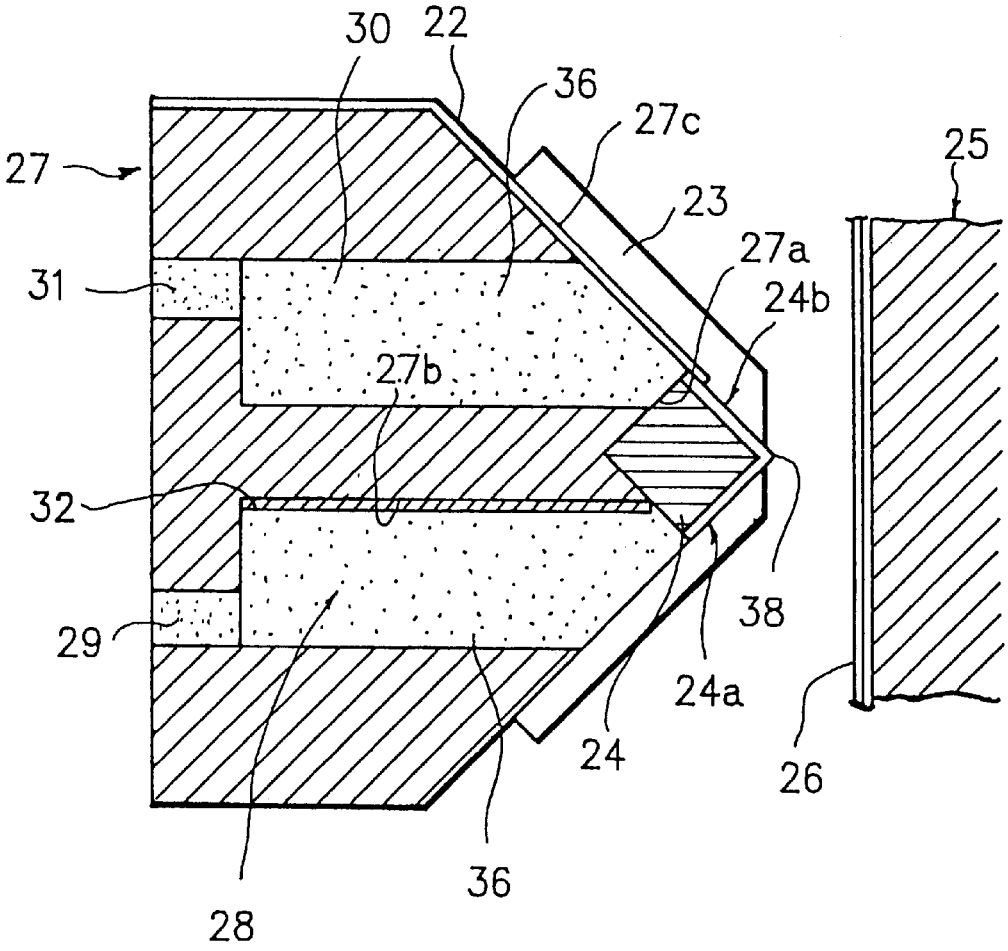
FIG. 14 is a vertical sectional view of the front part of the electrostatic ink jet printing head of FIG. 13 taken along the line 14—14.
Figure 15:
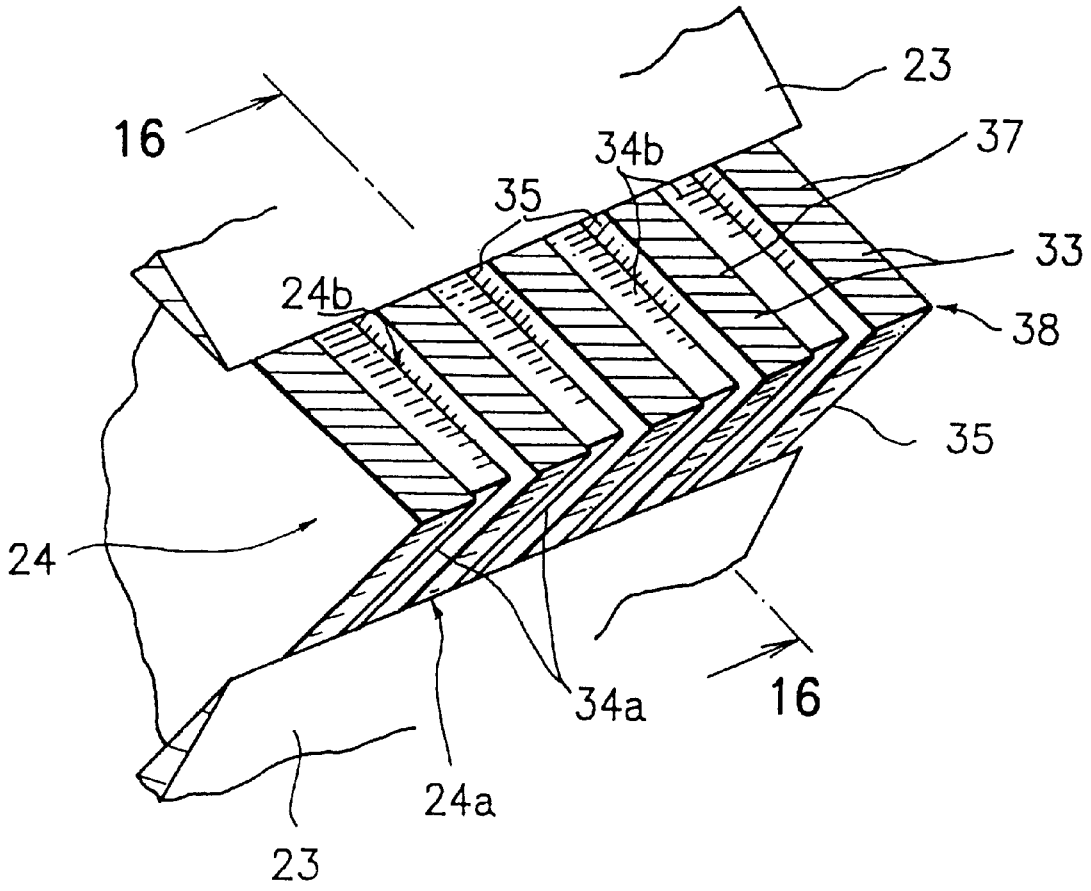
FIG. 15 is a perspective view of the tip of the electrostatic ink jet printing head of FIG. 13.
Figure 16:
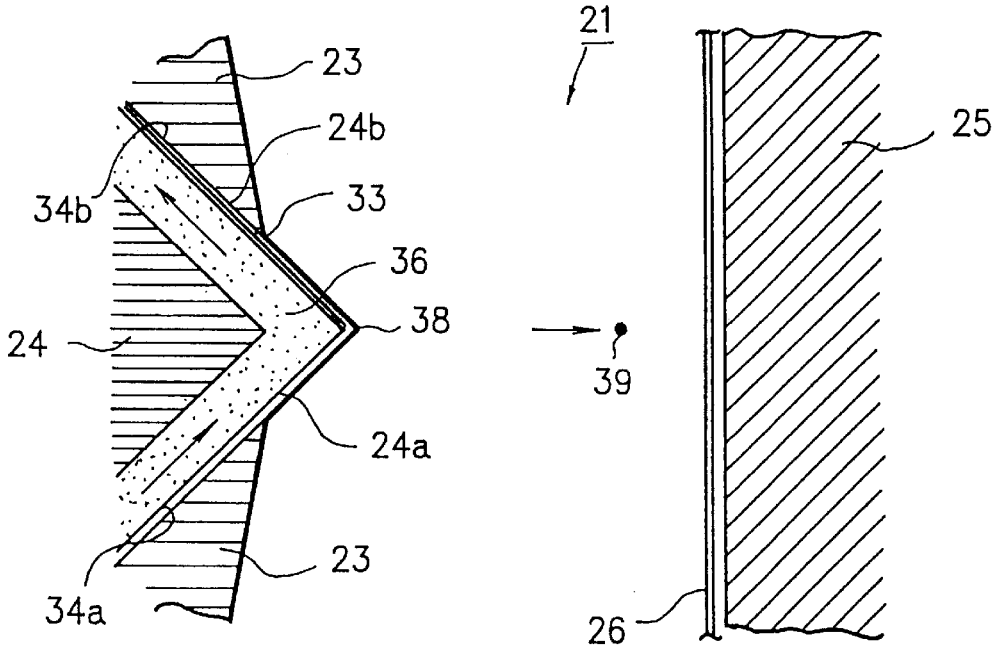
FIG. 16 is a vertical sectional view of FIG. 15 taken along the line 16—16.

FIG. 13 is a plan view of an electrostatic ink jet printing head according to the fifth embodiment of the present invention. FIG. 14 is a vertical sectional view of the front part of the head of FIG. 13 taken along the line 14—14. FIG. 15 is a perspective view of the tip of the head of FIG. 13. FIG. 16 is a vertical sectional view of FIG. 15 taken along the line 16—16. As shown in FIG. 14, the electrostatic ink jet printing head of the fifth embodiment comprises a head body 27, a head tip 24 attached to the head body 27, an ink supply chamber 28, an ink outlet chamber 30, and a counter electrode 25 which is placed at a predetermined distance (printing gap) from the head tip 24. The ink supply chamber 28 and the ink outlet chamber 30 are connected to an unshown ink tank of the ink jet printer which is provided with the electrostatic ink jet printing head of this embodiment, via an ink supply hole 29 and an ink outlet hole 31, respectively.

The head tip 24 substantially has a shape of a rectangular parallelopiped and is attached to a connecting groove 27*a* which is provided to the tip of the head body 27 parallel to the counter electrode 25. The head tip 24 has a first ink holding surface 24*a* and a second ink holding surface 24*b* which are facing the counter electrode 25. A plurality of recording electrodes 33 are provided to the second ink holding surface 24*b*, and a plurality of ejection points 38 are formed on a ridge of the head tip 24 between the first ink holding surface 24*a* and the second ink holding surface 24*b*. The head tip 24 is made of insulating material such as ceramics or polymers with a small dielectric constant. The recording electrodes 33 are formed discretely and each recording electrode 33 is connected to an unshown driver which is provided to the ink jet printer via a printed wiring film 22 which is attached to the upper surface of the head body 27. High voltage driving pulse signals are selectively applied to the recording electrodes 33 by the unshown driver for printing.

As shown in FIG. 15, a plurality of ink channel grooves 34*a* are formed on the first ink holding surface 24*a* and a plurality of ink channel grooves 34*b* are formed on the second ink holding surface 24*b*. Each ink channel groove 34*a* is connected with corresponding ink channel groove 34*b* for circulation of the ink. Each recording electrode 33 is patterned on each flat surface of the convexity 35 between the ink channel grooves 34*b* on the second ink holding surface 24*b*. The recording electrodes 33 are placed at intervals corresponding to the printing resolution desired for the head. Each recording electrode 2 is coated with an insulator coating layer 37 in order to insulate between the recording electrodes 33 and the ink. The ink channel grooves 34*a* and the convexities 35 are located alternately on the first ink holding surface 24*a* and the ink channel grooves 34*b* and the convexities 35 are located alternately on the second ink holding surface 24*b*.

Referring to FIG. 14, the ink supply chamber 28 is formed in the lower part of the head body 27 in order to supply the ink from the unshown ink tank to the ink channel grooves 34*a* on the first ink holding surface 24*a*, and the ink outlet chamber 30 is formed in the upper part of the head body 27 in order to send the ink from the ink channel grooves 34*b* on the second ink holding surface 24*b* to the unshown ink tank. The ink supply hole 29 for supplying the ink from the ink tank is formed at the rear end of the ink supply chamber 28, and the ink outlet hole 31 for discharging the ink to the ink tank is formed at the rear end of the ink outlet chamber 30.

On the upper surface 27*b* of the ink supply chamber 28, an electrophoresis electrode 32 made of electrically conducting material is placed in contact with the ink in order to concentrate the electrically charged toner particles in the ink 36 around the ejection points 38 by means of electrophoresis. The electrophoresis electrode 32 is connected to an unshown voltage source for applying a predetermined positive bias voltage.

A cover 23 is covering almost the whole surface of the first ink holding surface 24*a* and the second ink holding surface 24*b* in order to prevent overflows of excessive amount of the ink 36 from the ink channel grooves 34*a* and 34*b*, and is exposing the tip of the head tip 24 around the ejection points 38 to the air. The printed wiring film 22 such as a TAB tape which is known in the TAB (Tape Automated Bonding) technique is placed between the cover 23 and the upper slope 27*c* of the head body 27.

As shown in FIG. 13, a plurality of conducting patterns 46 are formed on the printed wiring film 22. Each recording electrode 33 is connected to the distal end of a corresponding conducting pattern 46, and the unshown driver is connected to the proximal ends of the conducting patterns 46.

The counter electrode 25 located at the predetermined distance from the recording electrodes 33 is made of electrically conducting material such as metal and is grounded or connected to an unshown voltage source, and the electrophoresis electrode 32 is kept in the ground voltage level or a predetermined negative bias voltage level. A paper 26 is fed in the printing gap between the counter electrode 25 and the recording electrodes 33, in contact with the counter electrode 25, and is kept in the same electric potential as the counter electrode 25.

In the following, the operation of the electrostatic ink jet printing head of the fifth embodiment will be described. According to activation of an unshown pump which is installed in the ink jet printer, the ink is supplied from the ink tank to the ink supply chamber 28 via the ink supply hole 29. The electric potential of the ink 36 is raised by the electrophoresis electrode 32 which is in contact with the ink 36 within such an extent that ejection of the toner particles does not occur. The ink 36 in the ink supply chamber 28 flows to the ejection points 38 through the ink channel grooves 34*a* on the first ink holding surface 24*a* held by capillary phenomenon, and form ink meniscuses at each ejection point 38. Then, the ink 36 is returned to the ink outlet chamber 30 via the ink channel groove 34*b* on the second ink holding surface 24*b*, and is returned to the ink tank via the ink outlet hole 31.

When printing is executed, the high voltage driving pulse signals are applied to selected recording electrodes 33 by the unshown driver. The electrically charged toner particles in the ink 36 are attracted to the counter electrode 25 by the force due to an electric field generated between the recording electrode 33 and the counter electrode 25. By the attracting force larger than the surface tension of the ink meniscus at the ejection point 38, agglomerations 39 of the electrically charged toner particles accompanied by a little liquid is ejected from the ejection point 38 to the counter electrode 25, thereby printing on the paper 26 according to printing data is executed.

In the same way as the previous embodiments, the ink 36 is circulated from the ink tank through the ink supply chamber 28, the ink channel grooves 34*a* on the first ink holding surface 24*a*, the ejection points, the ink channel grooves 34*b* on the second ink holding surface 24*b*. the ink outlet chamber 30, and to the ink tank, in which constant forced flow is generated in the ink 36 which is supplied to the ejection points 38. Therefore, fresh ink 36 is continuously supplied to the ejection points 38 and the toner particles which have not been ejected at the ejection points 38 are forcibly returned with the ink 36 into the ink tank via the ink outlet chamber 30 whether or not ejection is executed at the ejection points 38, thereby accumulation of the toner particles around the ejection points 38 is avoided and unstable or uneven ejection of the toner particles due to excessively higher concentration of the toner particles is prevented, and thus uniform printing can be executed independently of history of ejection of the recording electrodes 33.

Further, in the fifth embodiment, the ink outlet chamber 30 is placed above the ink supply chamber 28 to let the ink 36 flow upward. By the structure, influence of air bubbles mixing in the ink 36 flowing on the surface of the head tip 24 upon the ink 36 to be supplied to the ejection points 38 is considerably reduced and more stable printing can be executed.

In the following, an example of a manufacturing process of the head tip 24 of the electrostatic ink jet printing head according to the fifth embodiment will be described referring to FIG. 17 through FIG. 20.

Figure 17:
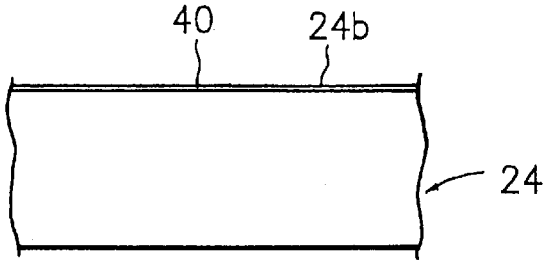
FIG. 17 through FIG. 20 are schematic diagrams showing steps involved in a manufacturing process of a head tip of the electrostatic ink jet printing head of FIG. 13.
Figure 18:
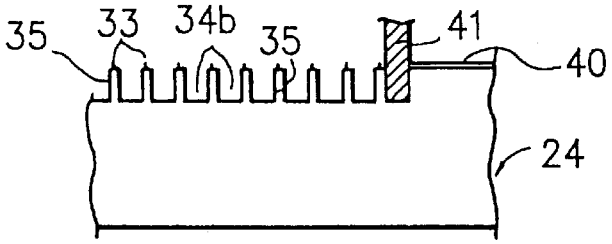

First, a conductor layer 40 of electrically conducting materiel such as Cu, Ni, etc. is formed by sputtering or plating on the second ink holding surface 24*b* of the head tip 24 which substantially has a shape of a rectangular parallelopiped, as shown in FIG. 17. Subsequently, using a machining blade 41, a plurality of ink channel grooves 34*b* are formed on the second ink holding surface 24*b* on which the conductor layer 40 has been formed, at intervals corresponding to printing resolution desired for the head, thereby the discrete recording electrodes 33 are formed on the convexities 35 between the ink channel grooves 34*b* as shown in FIG. 18. Thus, the recording electrodes 33 and the ink channel grooves 34*b* can be formed in one grooving step using the machining blade 41, without executing complicated patterning process such as photo-lithography for the discrete recording electrodes 33.

Figure 19:
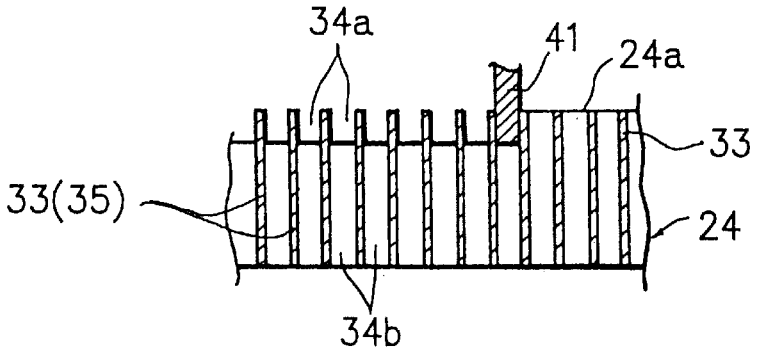

Subsequently, using the machining blade 41, a plurality of ink channel grooves 34*a* are formed on the first ink holding surface 24*a* which is adjacent to the second ink holding surface 24*b* so that the ink channel grooves 34*a* may be connected with the ink channel grooves 34*b*, as shown in FIG. 19.

Figure 20:
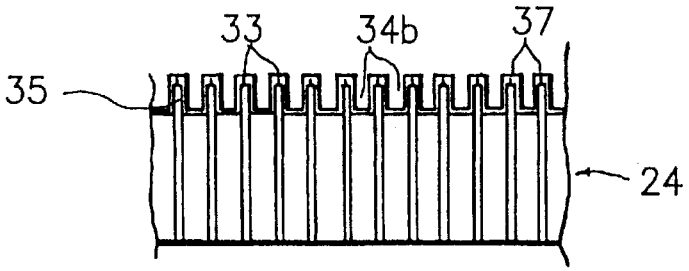

Then, an insulator coating layer 37 is formed on the recording electrode 33 on the second ink holding surface 24*b* in order to insulate between the recording electrode 33 and the ink as shown in FIG. 20.

The head tip 24 manufactured by the above process is attached to the connecting groove 27*a* of the head body 27 which is provided with the ink supply chamber 28, the electrophoresis electrode 32, the ink outlet chamber 30, etc. By manufacturing the head tip 24 of simple construction and attaching the head tip 24 to the head body 27, manufacturing process of the electrostatic ink jet printing head is simplified.

As set forth hereinabove, in the electrostatic ink jet printing head according to the present invention, stable ejection of the ink from each ejection point can be executed, since each ejection point is formed discretely on the convexity between the ink channel grooves and at the ridge between the two surfaces of the head block (i.e. the main body or the head tip) which are intersecting substantially at a right angle, and the ink channel grooves are formed in the upper reaches and in the lower reaches of the ink stream corresponding to each ejection point and the ink is forcibly circulated via the ink channel grooves, thereby smooth and stable supply and discharge of the toner particles are made possible and excessively higher concentration of the toner particles at the ejection points is prevented. In other words, concentration of the toner particles in the ink around the ejection points can be maintained at a constant high value and stable ejection can be executed by each ejection point, i.e. each recording electrode, independently of history of ejection of each recording electrode.

Further, stable ejection of the ink from definite and precise ejection points can be executed and high precision clear printing is realized with a simple structure of the head and at a low cost, since the ejection points on the convexities between the ink channel grooves formed by means of grooving by machining are located discretely and independently, and the ink meniscuses are formed surrounding each discrete ejection point, and electric field at the tip of the ink meniscus formed at the ejection point has the maximum value since the ejection point is located nearest to the counter electrode.

Furthermore, by the method for manufacturing a head block which composes an electrostatic ink jet printing head according to the present invention, a head block capable of executing stable ejection and precision printing is manufactured in a simple process and at a low cost.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. An electrostatic ink jet printing head comprising:

a head block made of insulating material having a first surface and a second surface, said first and second surfaces being major exterior planar surfaces of said head block which are intersecting substantially at a right angle at ink ejection points;

a plurality of ink channel grooves which are formed on the first surface and the second surface in directions perpendicular to a ridge between the first and second surfaces;

a plurality of recording electrodes which are formed on convexities between the ink channel grooves and near ejection points located on the ridge, and coated with insulating material; and a cover for covering the ink channel grooves and exposing the ejection points to air.

2. An electrostatic ink jet printing head as claimed in claim 1, wherein ink is forcibly circulated by a forcible ink circulation means from an ink tank through the ink channel grooves on the first surface, the ejection points, the ink channel grooves on the second surface, and to the ink tank.

3. An electrostatic ink jet printing head as claimed in claim 1, wherein the recording electrodes are formed in lower reaches of the ink stream compared to the ejection points.

4. An electrostatic ink jet printing head as claimed in claim 1 further comprising a plurality of electrophoresis electrodes formed in the ink channel grooves in upper reaches of the ink stream compared to the ejection points.

5. An electrostatic ink jet printing head as claimed in claim 4, wherein the electrophoresis electrodes are formed so that contact length along the ink stream between the electrophoresis electrodes and the ink may be variable.

6. An electrostatic ink jet printing head as claimed in claim 1, wherein the ink channel grooves are formed so as to become deeper toward an ejection point.

7. An electrostatic ink jet printing head as claimed in claim 1, wherein the head block is attached to the tip of a head body as a head tip.

8. An electrostatic ink jet printing head as claimed in claim 1 further comprising an ink supply chamber between an ink tank and the ink channel grooves on the first surface, and an ink outlet chamber between the ink channel grooves on the second surface and the ink tank.

9. An electrostatic ink jet printing head as claimed in claim 8, wherein an electrophoresis electrode is provided in the ink supply chamber in contact with the ink.

10. An electrostatic ink jet printing head as claimed in claim 8, wherein the ink outlet chamber is placed above the ink supply chamber.

11. An electrostatic ink jet printing head as claimed in claim 1, wherein the ink channel grooves are formed by means of grooving by machining.

12. An electrostatic ink jet printing head comprising:

a head block made of insulating material having a first surface and a second surface, said first and second surfaces being major exterior planar surfaces of said head block which are intersecting substantially at a right angle at ink ejection points;

a plurality of ink channel grooves which are formed on a ridge between the first surface and the second surface in a direction perpendicular to the ridge so that bottoms of the ink channel grooves may be substantially at 45 degrees from the first surface and the second surface;

a plurality of recording electrodes which are formed on convexities between the ink channel grooves and near ejection points located on the ridge, and coated with insulating material; and a cover for covering the ink channel grooves and exposing the ejection points to air.

13. An electrostatic ink jet printing head as claimed in claim 12, wherein ink is forcibly circulated by a forcible ink circulation means from an ink tank through the ink channel grooves, the ejection points, the ink channel grooves, and to the ink tank.

14. An electrostatic ink jet printing head as claimed in claim 12 further comprising an electrophoresis electrode in upper reaches of the ink stream compared to the ejection points.

15. An electrostatic ink jet printing head as claimed in claim 12, wherein the ink channel grooves are formed by means of grooving by machining.

16. A method for manufacturing a head block which composes an electrostatic ink jet printing head, comprising the steps of:

(1) forming a conductor layer on a second surface of a block made of insulating material which has a first surface and the second surface, wherein said first and second surfaces are major exterior planar surfaces of the block which are intersecting substantially at a right angle at what will become ink election points;

(2) forming a plurality of ink channel grooves on the second surface by means of grooving by mechanical machining, thereby forming a plurality of recording electrodes;

(3) forming a plurality of ink channel grooves on the first surface by means of grooving by machining so that the ink channel grooves on the first surface may be connected with the ink channel grooves on the second surface; and (4) forming an insulator coating layer on the recording electrodes.

17. A method as claimed in claim 16 further comprising the step of forming a plurality of electrophoresis electrodes on bottoms of the ink channel grooves on the first surface.

* * * * *